US006234573B1

(12) United States Patent
Röder et al.

(10) Patent No.: US 6,234,573 B1
(45) Date of Patent: May 22, 2001

(54) CHAIR, IN PARTICULAR OFFICE CHAIR

(75) Inventors: Peter Röder, Markstrasse 144, D-60388 Frankfurt am Main; Johannes Uhlenbrock, Drensteinfurt, both of (DE)

(73) Assignee: Peter Röder, Frankfurt am Main (DE)

( * ) Notice: Subject to any disclaimer, the term of this patent is extended or adjusted under 35 U.S.C. 154(b) by 0 days.

(21) Appl. No.: 09/343,102

(22) Filed: Jun. 29, 1999

Related U.S. Application Data

(63) Continuation-in-part of application No. 09/133,209, filed on Aug. 13, 1998, now abandoned.

(30) Foreign Application Priority Data

May 27, 1998 (DE) ..... 198 23 632

(51) Int. Cl.[7] ..... A47C 1/024
(52) U.S. Cl. ..... 297/300.5; 297/300.7
(58) Field of Search ..... 297/300.1, 300.5, 297/300.2, 303.4, 300.7, 300.8

(56) References Cited

U.S. PATENT DOCUMENTS

| | | |
|---|---|---|
| 4,200,332 | 4/1980 | Bräunig . |
| 4,471,994 | 9/1984 | Zünd et al. . |
| 4,709,962 | 12/1987 | Steinmann . |
| 4,709,963 | 12/1987 | Uecker et al. . |
| 4,761,033 | 8/1988 | Lanuzzi et al. . |
| 4,962,962 | 10/1990 | Machate et al. . |
| 4,966,411 | 10/1990 | Katagiri et al. . |
| 5,582,459 | 12/1996 | Hama et al. . |

FOREIGN PATENT DOCUMENTS 43 13 301 C2 12/1995 (DE) .

*Primary Examiner*—Anthony D. Barfield
(74) *Attorney, Agent, or Firm*—Sonnenschein Nath & Rosenthal

(57) ABSTRACT

A chair is provided in which the position and movement of the backrest, which is pivotally carried on a backrest carrier, is effected by movement of the seat top, which, in turn, is subjected to the weight of the seat user. The amount of the user's weight differently affects the position of the backrest through the use of pivoting linkages and a tension spring.

16 Claims, 10 Drawing Sheets

CHAIR, IN PARTICULAR OFFICE CHAIR

This application is a continuation-in-part of application Ser. No. 09/133,209, filed Aug. 13, 1998 now abandoned.

BACKGROUND OF THE INVENTION

The present invention relates to a chair, in particular an office chair comprising a seat top with at least one front seat support arm and at least one rear seat support arm projecting at the underside of the seat top, a seat carrier which is securely connected to a central chair column or several chair legs, and a backrest which is arranged at a backrest carrier firstly extending under the seat top backwards and thereafter upwards with the backrest carrier supported by means of a crosswise horizontally extending backrest carrier swivelling joint with the front seat support arm articulately connected to the seat carrier through at least one lever wherein the rear seat support arm offset backwards from the backrest carrier swivelling joint is articulately connected to the backrest carrier by means of a crosswise horizontally extending rear seat joint, and wherein a spring arrangement is provided under the seat top with the spring arrangement exerting a biasing force upwards upon the seat top and forwardly upon the backrest.

A chair of the type mentioned is known from DE 43 13 301 C2. The spring arrangement provided for this chair consists of a pressure spring which is arranged between the seat carrier and the seat top. By the arrangement of the single parts of this chair as explained above the chair offers the user the opportunities to selectively sit upwards on this chair or in a reclined position. In the reclined position the seat top will lower in the rear part, whereby at the same time the backrest with the backrest carrier will pivot backwards.

It is a disadvantage of this known chair that it offers no possibility to adapt the force acting upon the back of the user to the user, in particular to the body weight thereof. Therefore the known chair is only a compromise regarding the force acted upon the back of the user by the backrest, which in many cases is not optimal, in particular when the chair is used by light weight or heavy weight users.

SUMMARY OF THE INVENTION

It is therefore an object of the invention to provide a chair of the type mentioned above which avoids the disadvantages mentioned, and wherein the force acted upon the back of the user by the backrest may be adapted to the body weight of the user, wherein an automatic adaption must be possible.

For attaining this object, a chair of the type mentioned above is proposed characterized in that the lever connecting the front seat support arm with the seat carrier is designed as a two-arm swivelling lever, pivotable around a crosswise horizontally extending swivelling axis, and supported at the seat carrier, with the one lever arm of the swivelling lever articulately connected to the front seat support arm, and with the other lever arm of the swivelling lever connected to one end of the spring arrangement. The other end of the spring arrangement is connected to the backrest carrier in spaced relation from the backrest carrier swivelling joint.

It is essential for this novel chair that the single pressure spring acting directly onto the seat top used in the state of the art is replaced by a spring arrangement with the biasing force thereof variable by means of the two-arm swivelling lever, wherein the variation is automatically attained by the weight load of the seat top by the user of the chair. Without a manual operation it is thereby attained that with light weight users of the chair, the backrest exerts only a smaller force upon the back of the user, and that with heavy weight users of the chair, the backrest exerts a larger force upon the back of the user, such that depending upon the weight of the user of the chair, the back of the user is always supported with an adequate and suitable force by the backrest. At the same time, the mechanical effort for realizing this adaption of the force of the backrest is relatively small, such that the chair according to the invention may be manufactured at low cost, and may be produced in a stable, safe, and durable way without much effort.

In the first embodiment of the chair according to the invention it is provided that at least one tension spring is the spring arrangement, wherein the second lever arm of the swivelling lever connected to the front end of the tension spring points backwards, and wherein the connection of the rear end of the tension spring with the backrest carrier is offset upwards from the backrest carrier swivelling joint. With this arrangement of the spring arrangement the required function is attained in a technically simple and reliable fashion. Furthermore the production costs are kept low, and it is only relatively little space required for the accommodation of the spring arrangement.

Furthermore, it is preferably provided that the swivelling lever is designed as a strain lever or as a lever angled up to 45° at maximum. This design of the swivelling lever has the advantage that the lever may be easily manufactured, and that a flat construction of the parts of the chair mechanism arranged under the seat top is possible. This will reduce the room requirement for the chair mechanism under the seat top, and improves the optical appearance of the chair, in particular when viewed from the side.

In order to willingly influence and vary the support force acted upon the back of the user of the chair by the backrest, optionally the force of the tension spring acted upon the backrest may be adjustable.

For this reason, in a further embodiment it is provided that the connection point of the rear end of the spring arrangement at the backrest carrier is adjustable in the distance from the backrest carrier swivelling joint. By this means, the lever arm between the spring arrangement and the backrest carrier may be varied in the length thereof, which takes care of the required change of the backrest force.

Furthermore, it is preferably provided that the rear end of the spring arrangement is connected to the backrest carrier through a pivotable adjusting lever which may be locked. By this design, the biasing force of the spring arrangement is hardly changed, however, the lever effect between the spring arrangement and the backrest carrier is varied in dependence from the corresponding position of the adjusting lever.

Preferably at least one helical leg, torsion bar, gas pressure, rubber or elastomer spring is provided as the spring arrangement wherein such springs are cheap and easily accessible construction members which may be purchased in the market without any problems.

To lock the chair in at least one base position when not in use, and in case that the user of the chair wants to use it in a fixed position, and e.g., does not want the reclined position, it is provided that the backrest carrier pivotable around the backrest carrier swivelling joint may be locked in continuous or stepped swivelling positions.

A first embodiment of the chair with the locking capability of the backrest carrier mentioned before provides that at least one one-arm catch lever pivotable around a horizontal swivelling axis is connected to the backrest carrier in vertically spaced relationship from the back-rest carrier swivelling joint with the catch lever substantially extending horizontally to the seat carrier, and freely displaceable in its longitudinal direction in relation to the seat carrier in a first, automatically occupied release position, and in a locking fashion engaging a locking element in a second locking position occupied by adjusting an actuating element, wherein the locking element prevents a displacement of the catch lever in relation to the seat carrier. When the catch lever is in its release position the movements of the seat top and the backrest in relation to the seat carrier are not hindered, only when the catch lever takes its locking position by adjusting the actuating element a further movement of the seat top at the backrest in relation to the seat carrier and in relation to each other is prevented.

A preferred further development provides that the locking element is at least one bolt extending through an elongated hole in the catch lever, wherein the elongated hole comprises at least one indentation extending downward for receiving the bolt in a locking position. In the release position of the catch lever, the bolt extends through the elongated hole such that the bolt extends through the elongated hole such that the bolt and the catch lever may freely move in relation to each other. When the catch lever is raised, and the bolt gets into the indentation, this movement is no longer possible and the seat top and the backrest are locked. This locking position is secured by the spring force of the spring arrangement, and the friction between the bolt and the indentation is such that the locking of the seat top and the backrest carrier are automatically maintained. Only when the seat top and the backrest again are loaded by a user is the spring force influenced such that the locking is released, wherein the catch lever will fall downwards around its swivelling axis and again attains its release position.

Thereto an alternate embodiment of the chair provides that the locking element is formed by several projecting teeth extending in parallel at a radius around the swivelling axis of the catch lever with the teeth engageable and disengageable with corresponding teeth attached to the catch lever. With this embodiment of the locking element and catch lever, the same function is attained as has been described above. Moreover with this second embodiment a finer stepping of the locking positions is possible.

As an alternate to the two embodiments described before. the spring arrangement may be a gas pressure spring which may be locked in continuous or stepped positions. This gas pressure spring to be locked offers the desired spring force and at the same time enables a locking of the backrest carrier, and the backrest connected therewith, in a desired position which may be selected within the total range of movement of the backrest carrier. When the gas pressure spring is released, the chair has the movability of the backrest which was described before, wherein a swivelling of the backrest backwards in connection with a lowering of the rear part of the seat top is possible solely by displacing the load of the user of the chair.

The ratio of the movements of the rear end of the seat top on the one hand, and the backrest on the other hand is fixed by the distance of the rear seat joint from the backrest carrier swivelling joint. In a simple embodiment of the chair, a fixed positioning may be selected which is suitable for most users. Alternately it is provided that the rear seat joint is adjustable and may be locked in its position in relation to the backrest carrier in the longitudinal direction thereof. In this way the ratio of the movements of the rear end of the seat top and the backrest may be changed at will, wherein the rear seat joint is pushed in its position in relation to the seat carrier either frontally, i.e., closer to the backrest carrier swivelling joint, or backwards, i.e., further away from the backrest carrier swivelling joint, and then locked in the desired position. When the rear seat joint is positioned closer to the backrest carrier swivelling joint, a larger swivelling movement of the backrest will result with a simultaneous lowering of the back end of the seat top, vice versa with a further backwards positioned rear seat joint, a smaller swivelling angle of the backrest will result with a fixed lowering of the seat top.

Finally, it is provided that the chair according to the invention that two front and two rear seat support arms, two backrest carriers, and two springs are provided symmetrical in relation to the chair longitudinal middle plane. In this way the chair, in particular the seat top and the backrest thereof, is not susceptible against tilting forces, wherein simultaneously an economical production of the chair remains because all parts which are used in pairs may be identical.

BRIEF DESCRIPTION OF THE DRAWINGS

In the following embodiments of the chair according to the invention are explained referring to a drawing.

DETAILED DESCRIPTION OF THE PREFERRED EMBODIMENTS

Figure 1:
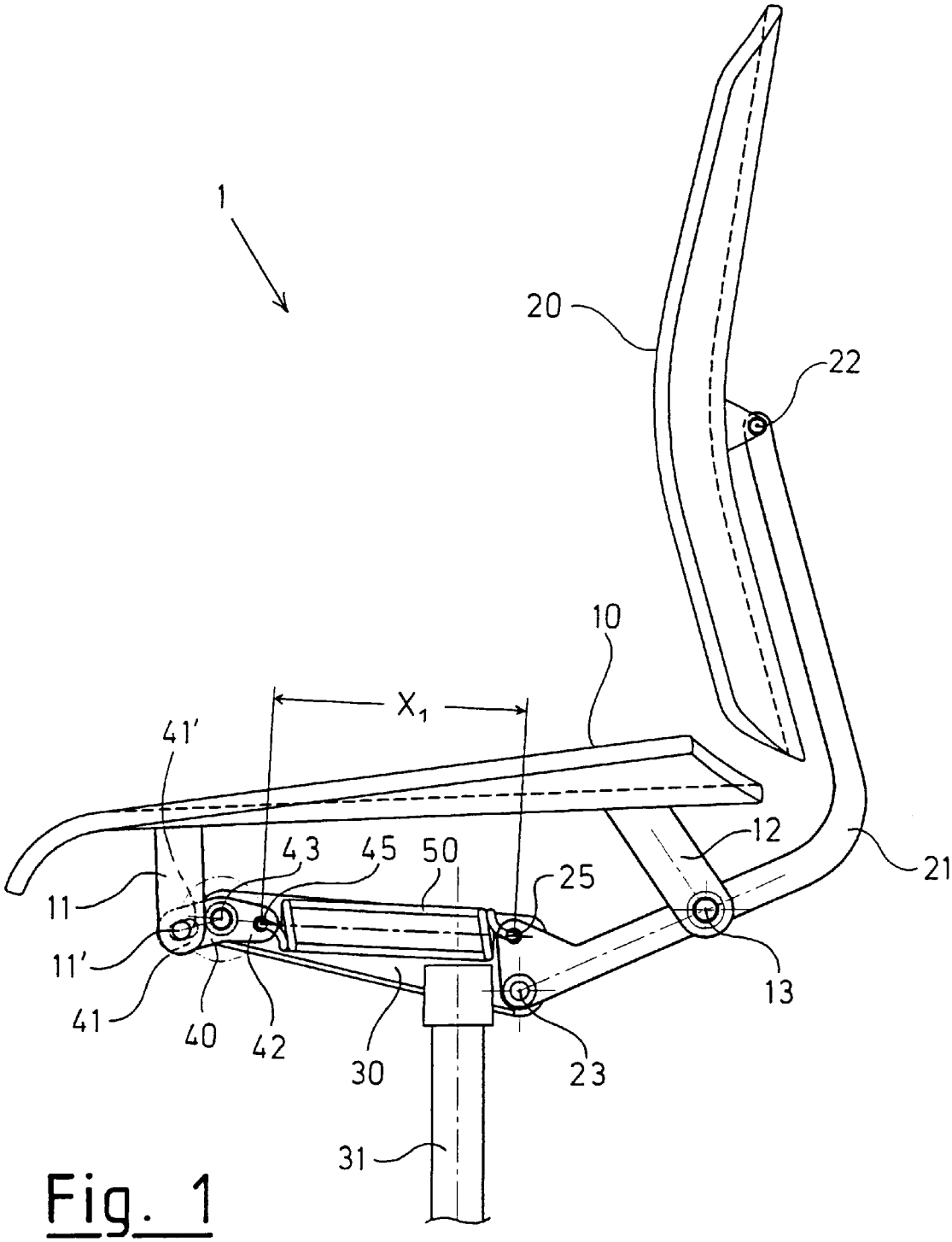
FIG. 1 shows a chair in a side elevational view, when used by a light weight user, in an upright position.

In FIGS. 1–4, embodiments of a chair 1 are shown which, in this case, is an office swivelling chair. The chair 1 comprises a seat top 10 and a backrest 20 which is behind the seat top, which is at the right side of the figure. From the underside of the seat top 10 a front seat support arm 11 extends downwardly and a rear seat support arm 12 extends downwardly. From the backrest 20 a backrest carrier 21 extends firstly downwardly and then forwardly below the seat top 10. The backrest 20 is articulately connected with the backrest carrier 21 by means of a backrest bearing 22 with a horizontally and crosswise extending swivelling axis in relation to the chair 1.

Below the seat top 10 a seat carrier 30 is provided which is securely connected to the upper end of a central chair column 31. The chair column 31 is only illustrated in the upper part thereof. At its lower part a standard and known foot arrangement is provided. Furthermore, the chair column 31 may be adjustable in its height and spring loaded, as well known.

The seat carrier 30 extends with the most part of it forwardly of the chair column 31 in the direction of the front seat support arm 11. At the front end, a two-arm swivelling lever 40 is supported at the seat carrier 30, with the swivelling lever pivotable around a swivelling axis 43 extending horizontally and crosswise in relation to the chair 1. A front lever arm 41 of the swivelling lever 40 is articulately connected to the lower end of the front seat support arm 11 through a joint bolt 11'. A front end of a tension spring 50, in this case a helical tension spring, is connected with a rear lever arm 42 of the swivelling lever 40 at a connection point 45. The arms 41, 42 are angled from each other between 0° and 45°.

Rearwardly of the chair column 31, to the right in the drawing, the seat carrier 30 is connected with the lower front end of the backrest carrier 21 by means of a backrest carrier swivelling joint 23. This backrest carrier swivelling joint 23 also comprises a swivelling axis extending horizontally and crosswise in relation to the chair 1.

Above the backrest carrier swivelling joint 23, and spaced therefrom, a rear end of the tension spring 50 is connected to the backrest carrier 21 at a further connection point 25.

The rear sear support arm 12 is articulately connected with the backrest carrier 21 by means of a rear seat joint 13, wherein the rear seat joint 13 is spaced rearwardly from the backrest carrier swivelling joint 23. Also, this rear seat joint 13 comprises a swivelling axis extending horizontally and crosswise in relation to the chair 1.

In FIG. 1 the chair 1 is illustrated in the position wherein the user has an upright sitting position and sits on it, wherein the user of the chair is not illustrated. In this case only a relatively small force acts upon the seat top 10. The result is that the swivelling lever 40 is swivelled counterclockwise only a relatively small distance against the tension force of the spring 50, wherein the front seat support arm 11 presses the front lever arm 41 downwards with a correspondingly small force. In this position of the chair when the load is small, the backrest carrier 21 presses against a stop, which is not illustrated, with the stop preventing a further forwardly swivelling of the backrest 20 beyond the position shown in FIG. 1.

Figure 2:
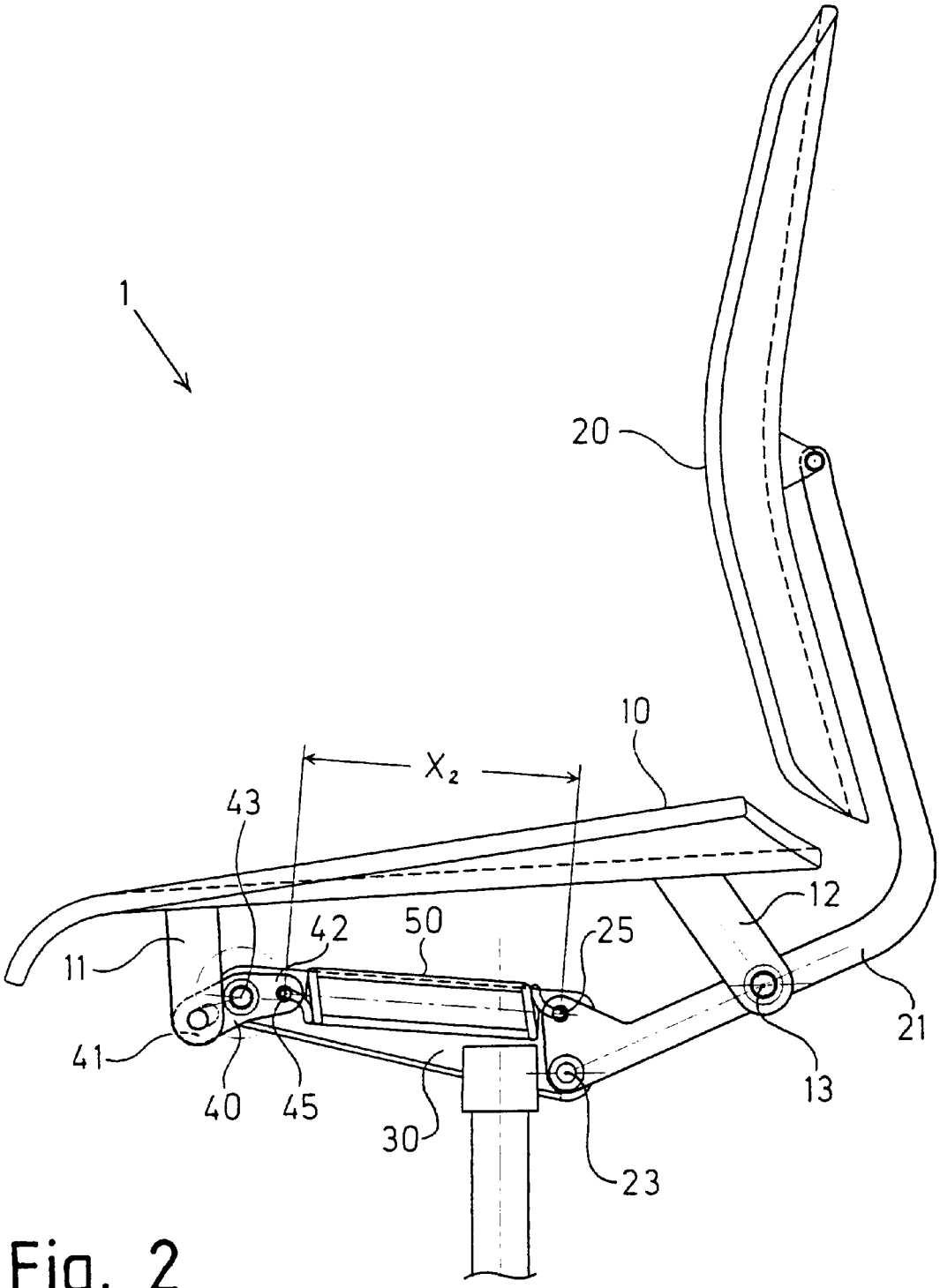
FIG. 2 shows the chair of FIG. 1 in a side elevational view when used by a heavy weight user.

FIG. 2 of the drawing illustrates the chair 1 in the same way as in FIG. 1, however, in a position when a heavy weight user sits on it. In this case a larger weight load acts upon the seat top 10, which leads to the fact that the front seat support arm 11 acts with a larger force upon the front lever arm 41 of the swivelling lever 40. This larger force has the consequence that the swivelling lever 40 is pivoted counterclockwise in a larger swivelling angle around the swivelling axis 43 than shown in FIG. 1. This larger swivelling movement of the swivelling lever 40 results in a larger tension of the tension spring 50. Hereby it is attained that a larger lever force is acted upon the backrest carrier 21 by the rear end of the spring 50 and the connection point 25, leading to a forwardly pivoting of the backrest 20. Thereby it is attained, that when the chair 1 is used by a heavy weight user, the backrest 20 is biased with a larger frontal force by the spring 50 leading to an automatic adaption to the occurring load.

Figure 3:
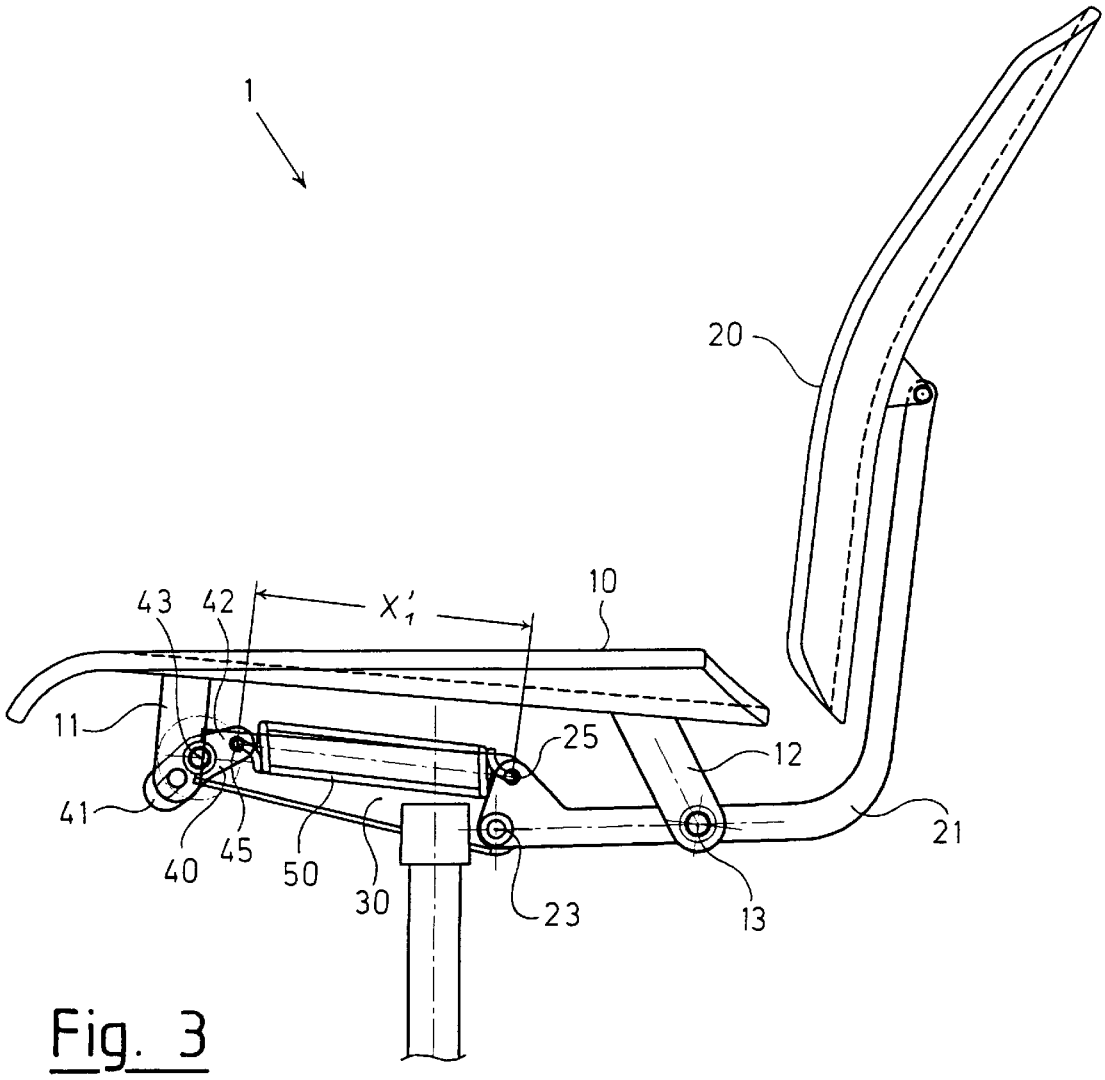
FIG. 3 shows the chair of FIG. 1 in a side elevational view when used by a light weight user, in a reclined position.
Figure 4:
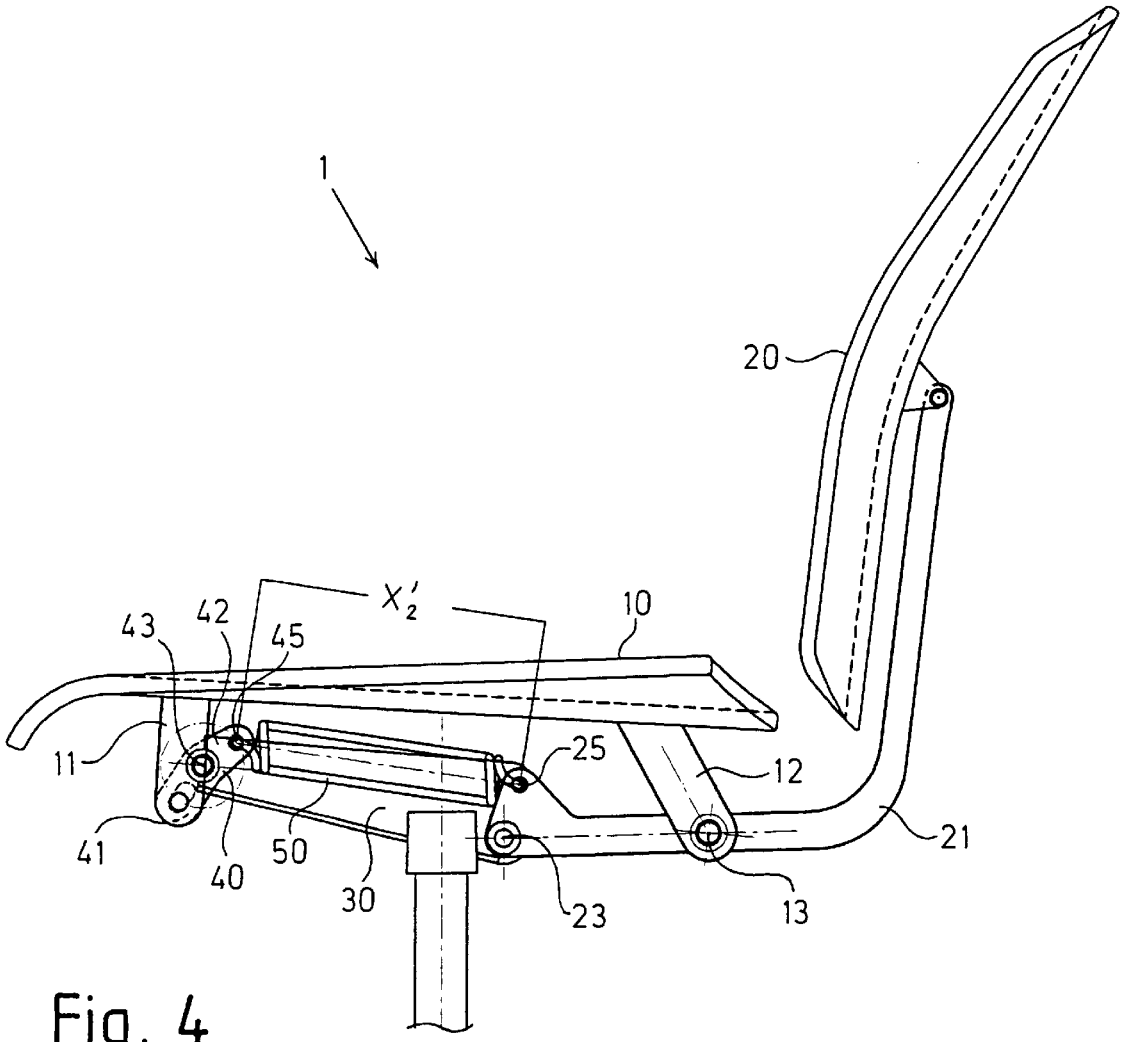
FIG. 4 shows the chair of FIG. 1 in a side elevational view when used by a heavy weight user, in reclined position.

FIGS. 3 and 4 of the drawing illustrate the chair 1 in a position which occurs in a reclined position of the user, wherein FIG. 3 illustrates the position with a light weight user, and FIG. 4 illustrates the position with a heavy weight user of the chair 1. The difference of the positions of the chair 1 in FIG. 3 and FIG. 4 is that in FIG. 3, the swivelling lever 40 is pivoted counterclockwise to a smaller degree than is the case with the swivelling lever 40 in FIG. 4. The different degree of swivelling lever 4 results from the different weight load acting upon the seat top 10 by the user, which is smaller in FIG. 3 as compared with the case in FIG. 4. Also in this position of the chair 1, the weight exerted upon the back of the user by the backrest 20 is adapted to the body weight of the user because in the case of FIG. 3, the tension spring 50 is tensioned to a lesser degree than in FIG. 4. The greater the tension spring 50 is biased, the larger is the forward force acting upon the back of the user of the chair by the backrest 20. Also, and more so in the reclined position of the chair user, the backrest force will adapt to the requirements of the body weight of the user.

As a measure for the spring tension in FIGS. 1–4, the distance of the connection points 25, 45 of the two spring ends of the tension spring 50 is illustrated. When comparing FIGS. 1 and 2, spring length $X_1$ is smaller than spring length $X_2$. Therefore, in FIG. 1 the tension force of the tension spring 50 is smaller than shown in FIG. 2. When comparing FIGS. 3 and 4 the length of the tension spring 50 in the one case is $X_1'$, and in the other case $X_2'$, with $X_1'$ smaller than $X_2'$.

FIGS. 1–4 illustrate that with a chair 1 in an upright position of the user according to FIGS. 1 and 2, the seat top extends forwardly with a small downward directed inclination. This inclination is ergonomicly favorable and desired because the blood circulation in the user's legs is not hindered. When the chair user reclines, in addition to besides a pivoting of the backrest 20 backwards at the same time, a lowering of the rear part of the seat top 10 will occur which in this reclined position is sensed as pleasant. This enables a relaxed sitting position, and at the same time avoids a shifting of the backrest 20 at the chair user's back which is sensed as unpleasant.

Figure 5:
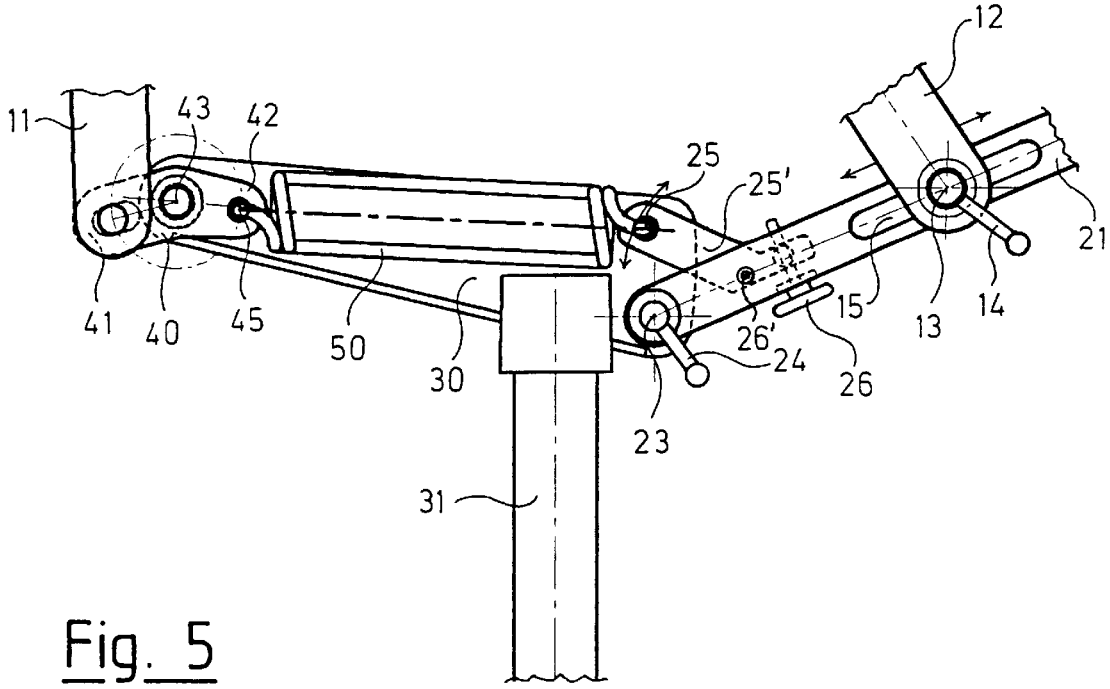
FIG. 5 shows a changed embodiment of the chair of FIGS. 1–4 in an enlarged partial side elevational view.

In FIG. 5 a variation of this chair with additional devices is illustrated, wherein in this case, only a section of the chair below the seat top is illustrated.

A first additional feature with this embodiment of the chair according to FIG. 5 is that the backrest carrier swivelling joint 23 may be locked in desired position. For this reason, at the backrest carrier swivelling joint 23, a locking mechanism with a manually adjustable locking lever 24 is provided, wherein in the one position of the locking lever 24, the backrest carrier swivelling joint 23 is freely movable, and wherein in the other position of the locking lever 24, the backrest carrier swiveling joint 23 may be locked in a previously selected position and then is stationary. In this way the chair user may prevent a swivelling movement of the backrest carrier 21 with the backrest 20.

A further additional feature is that the connection point 25 of the rear end of the spring 50 is variable in its position in relation to the backrest carrier swivelling joint 23, and may be locked in a desired position, wherein the means for changing the position and locking it in this case are provided by a pivotable adjustment lever 25' which may be locked. A swivelling axis 26' of the adjustment lever 25' extends parallel to the swivelling axis of the backrest carrier swivelling joint 23, and offset rearwardly therefrom through the backrest carrier 21. A hand wheel threaded spindle 26 at the backrest carrier 21 provides the adjustment. By this means, the lever effect of the tension spring 50 is preselectable in order to provide a base position of the force acted by the backrest 20 upon the back of a user. The adjustment of the connection point 25 is attained along an arcuate course at a radius around the swiveling axis 26'.

Finally it is illustrated at the right side of FIG. 5 that the rear seat joint 13, in its position in relation to the backrest carrier 21, is adjustable in longitudinal direction thereof and may be locked. For this reason, a guide slot 15 is provided in the backrest carrier 21 along which the rear seat joint 13 is adjustable in longitudinal direction of the backrest carrier 21. A locking mechanism is connected to the rear seat joint 13 with the locking mechanism to be released if desired through a second locking lever 14, and to be secured after reaching the desired position of the rear seat joint 13. By this adjustability of the rear seat joint 13, the transfer ratio between the lowering angle of the rear end of the seat top 10 and the swivelling angle of the backrest carrier 21 with the backrest 20 is changed, whereby an adaption to the individual requirements of the chair user is possible in an even greater range.

Regarding the numerals in FIG. 5 and further details, reference is made to the above description in particular to FIG. 1.

Figure 6:
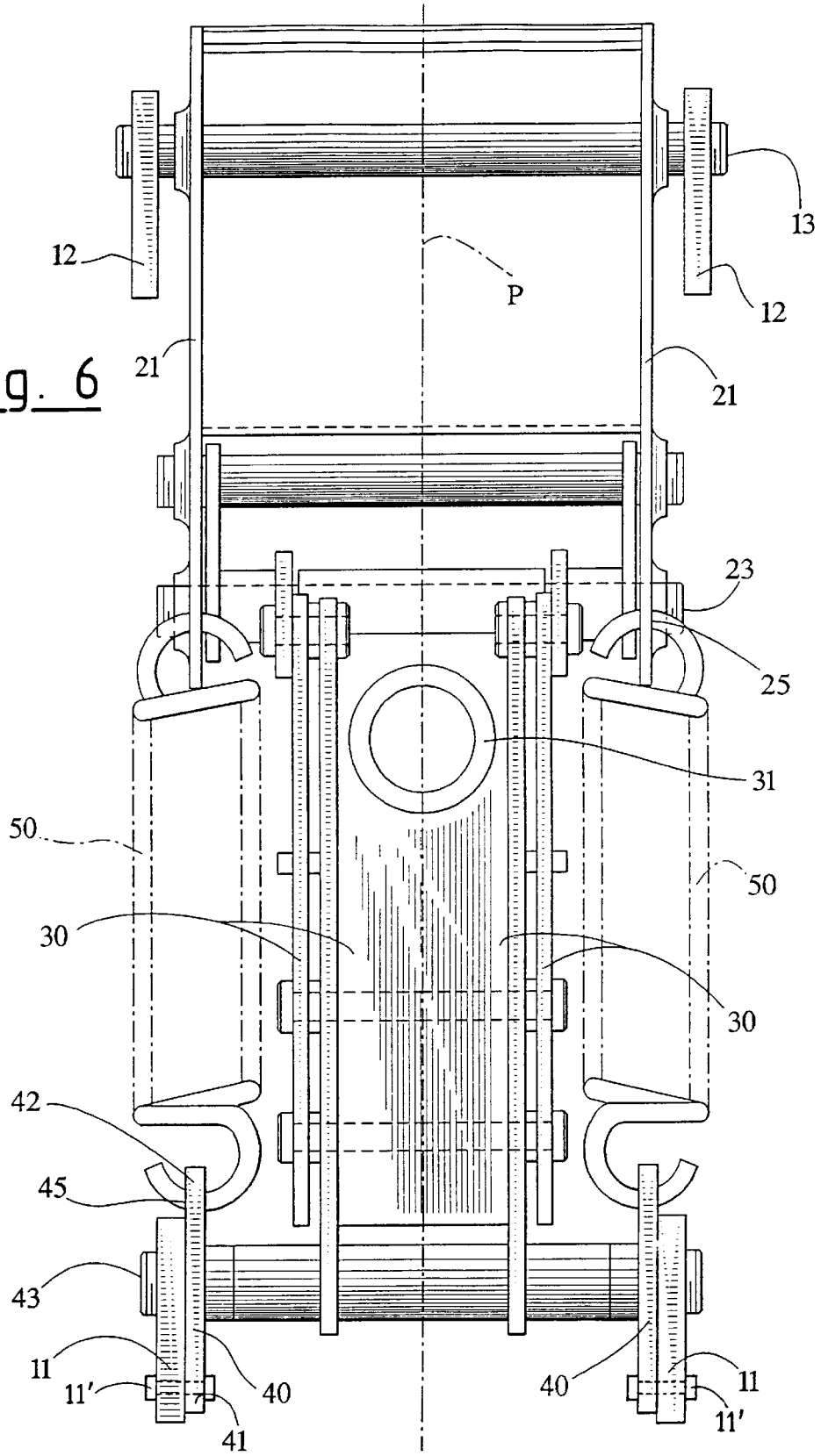
FIG. 6 shows the chair according to FIGS. 1–4 in a bottom elevational view.

FIG. 6 of the drawing illustrates a bottom view of a chair wherein the seat top and the backrest are not shown. In the middle of FIG. 6 in a section the chair column 31 is visible with the seat carrier 30 secured at the upper end which is facing away from the viewer. At the upper end of the seat carrier 30 the backrest carrier swivelling joint 23 extends by means of which two backrest carriers 21 extending in parallel with each other are articulately connected to the seat carrier 30. By means of the rear seat joint 13 two seat support arms 12 running also in parallel with each other are articulately connected to the backrest carriers 21.

At the lower end of the seat carrier 30 the swivelling axis 43 is visible whereabout the two one-armed swivelling levers 40 are pivotable. Beside each swivelling levers 40 are pivotable. Beside each swivelling lever 40 a front seat support arm 11 is positioned which together with the two rear seat support arms 12 support the seat top which is not illustrated. The front lever arm 41 of each swivelling lever 40 is articulately connected with the front seat support arm 11 through a joint bolt 11' The one end of the helical tension spring 50 at a spring connection point 45 engages the correspondingly other lever arm 42 of the swivelling lever 40. The correspondingly other rear end of the spring 50 is secured at a spring connection point 25 at the backrest carrier 21.

In FIG. 6 the symmetrical arrangement of the single part of the mechanics of the chair is clear to be symmetrical in relation to a longitudinal middle plane P shown as a dash-dotted line. By this symmetrical arrangement the movable parts of the chair are particularly stable ensuring a reliable function over a long period of time.

Figure 7:
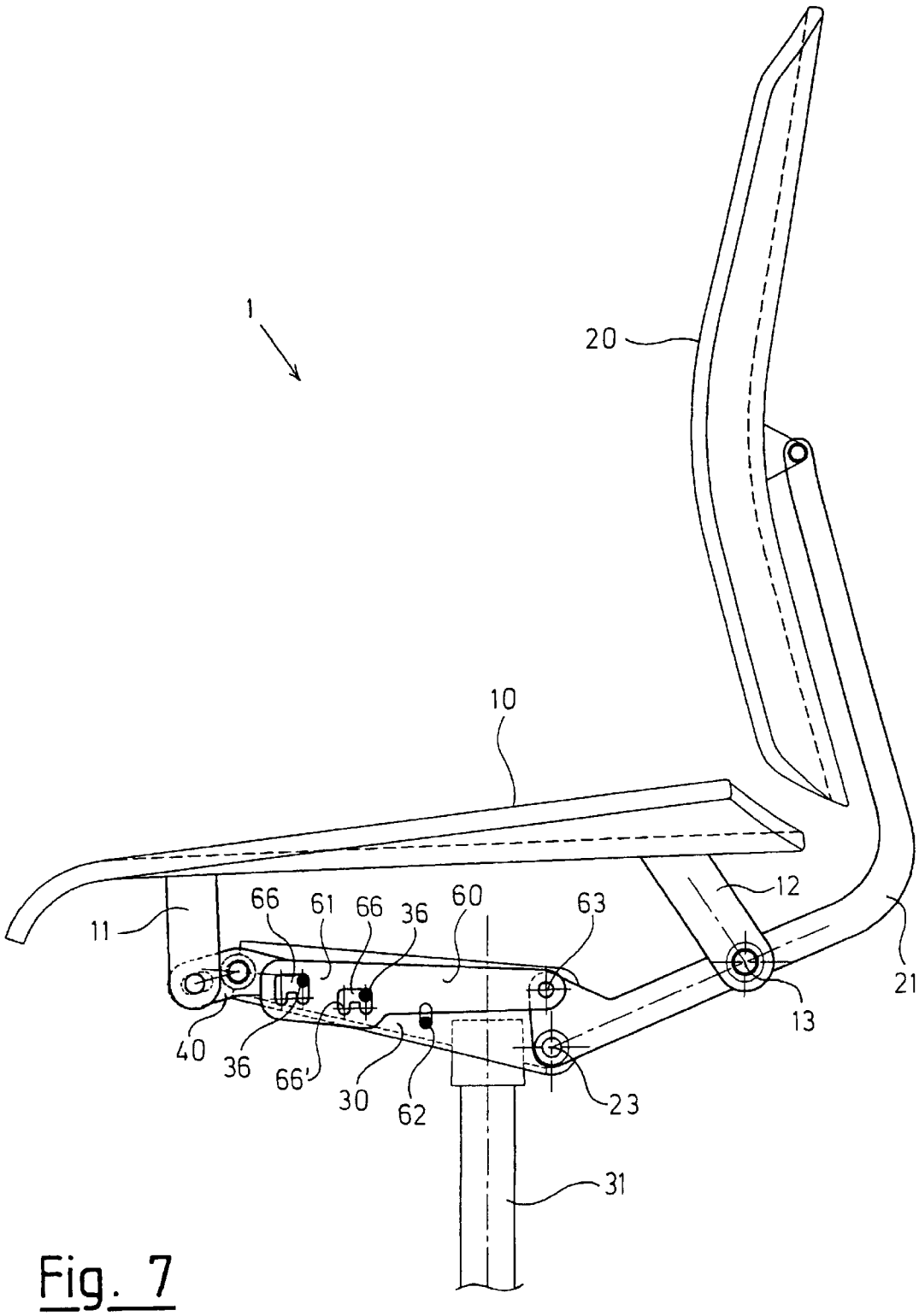
FIG. 7 shows an embodiment of the chair according to FIG. 1 in a side elevational view additionally with a locking in a release position.
Figure 8:
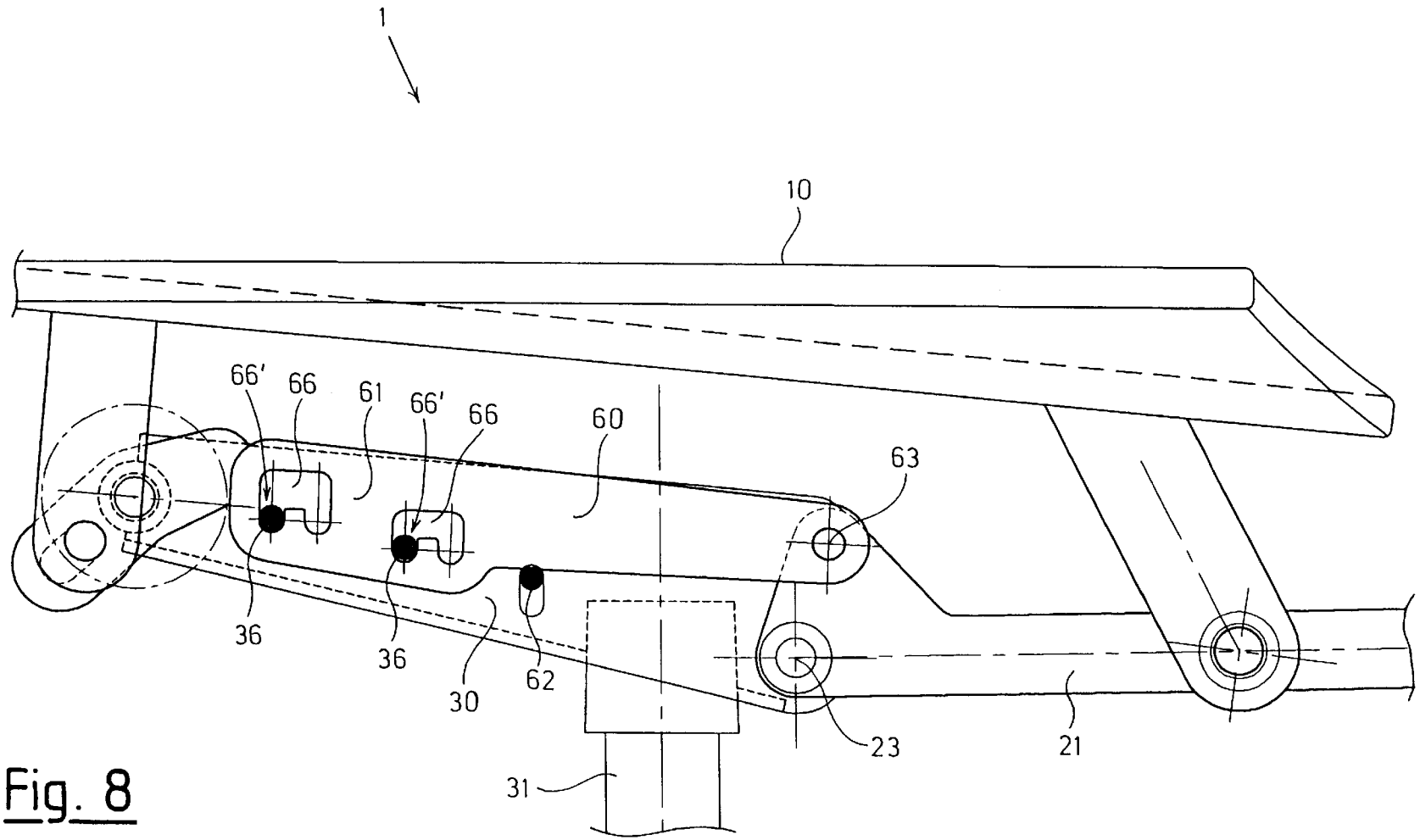
FIG. 8 shows the chair of FIG. 7 in an enlarged partial side elevational view, now with the locking in a locking position.

In FIGS. 7 and 8 an embodiment of the chair 1 is illustrated wherein a locking of the backrest 20 and the seat top 10 is possible in two preselected positions. For this end a catch lever 60 is connected to the front end of the backrest carrier 21 (at the left end in the drawing) above the backrest carrier swivelling joint 23 by means of a swivelling axis 63 with the catch lever extending in parallel with the seat carrier 30 forward, i.e., to the left in the drawing. The catch lever 60 is freely pivotable around a swivelling axis 63 and under influence of gravity takes the position illustrated in FIG. 7. Furthermore the catch lever 60 comprises two elongated holes 66 in its free front part 61 with the elongated holes substantially extending in horizontal direction, which is the longitudinal direction of the catch lever, with the elongated holes comprising a downwards extending indentation 66' at its front end, and at its rear end. Through each elongated hole 66 a locking element 36 designed as a bolt extends crosswise to the elongated hole, with the locking element secured to the seat carrier 30. Furthermore, an actuating lever 62 is provided in the seat carrier 30, with the actuating lever 62 falling downwards in a position visible in FIG. 7 without exerting an actuating force.

In this automatically occupied position of the catch lever 60, the backrest carrier 21 may freely move forward and backwards, wherein the catch lever 60 will move forward and backwards in horizontal direction in relation to the seat carrier 30 and the locking element 36 secured thereto.

In order to lock the seat top 10 in the backrest 20 in a required position, the user of the chair will pull the actuating lever 62 upwards, whereby the catch lever will take its position as shown in FIG. 8. By a backwards or forward leaning by the user of the chair 1, the backrest 20 will move into its rear or front end position, wherein the front or rear one of the indentations 66' will engage the locking element 36. To move the catch lever 60 into this position the user has to move the actuating lever 62 upwards and load it with an upwards directed force until the indentations 66' of the two elongated holes 66 will engage one of the two possible positions of the associated locking elements 36. After attaining this locking position of the catch lever 60, the user of the chair 1 may stand up and release the actuating lever 62. Thereby the locking is maintained because the catch lever 60 will maintain its position because of the force of the spring arrangement 50 not illustrated in FIGS. 7 and 8 and the friction at the locking elements 36.

When a user again will take a seat at the chair 1 and will slightly move to the front or to the back, the backrest 20 will be pivoted correspondingly, and the locking of the chair is released without further actuating means as the friction between the catch lever 60 and the locking elements 36 is no longer there. Thereby the catch lever 60 will fall downwards and take its release position illustrated in FIG. 7.

Figure 9:
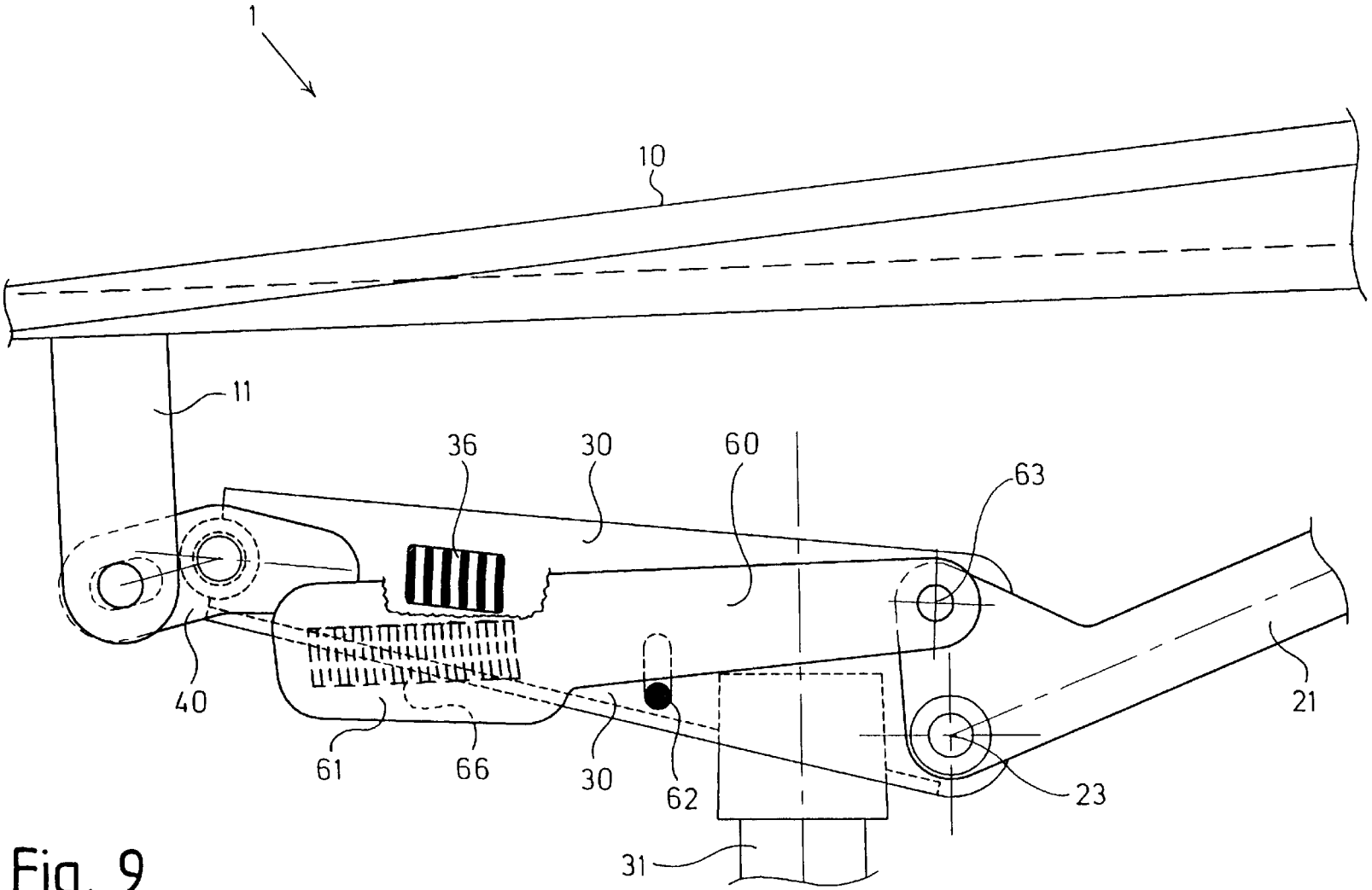
FIG. 9 shows an embodiment of the chair according to FIGS. 1–4 in an enlarged partial side elevational view with a changed design of the locking in a release position.

Finally, FIG. 9 of the drawing illustrates a changed embodiment of the chair 1 in a changed design of the locking means. Also in the example according to FIG. 9 a pivotable catch lever 60 is used which in the same way as in FIGS. 7 and 8 is pivotable around the swivelling axis 63, and which may be pivoted from its release position illustrated in FIG. 9 upwards into its locking position by means of an actuating lever 62.

Instead of elongated holes and bolts, in this example teeth are provided at the side of the catch lever 60 facing away from the viewer, and corresponding teeth 36 at the side of the seat carrier 30 facing the viewer, with both sets of teeth engageable with each other. The teeth 36 and 66 are each designed with a slight curve which extends at a radius around the swivelling axis 63. The function of the locking according to FIG. 9 corresponds with that according to FIGS. 7 and 8, wherein the difference is only that in the example according to FIG. 9 a finer stepping of the possible locking positions is attained. Regarding the remaining numerals in FIGS. 7, 8 and 9, reference is made to the preceding description.

Figure 10:
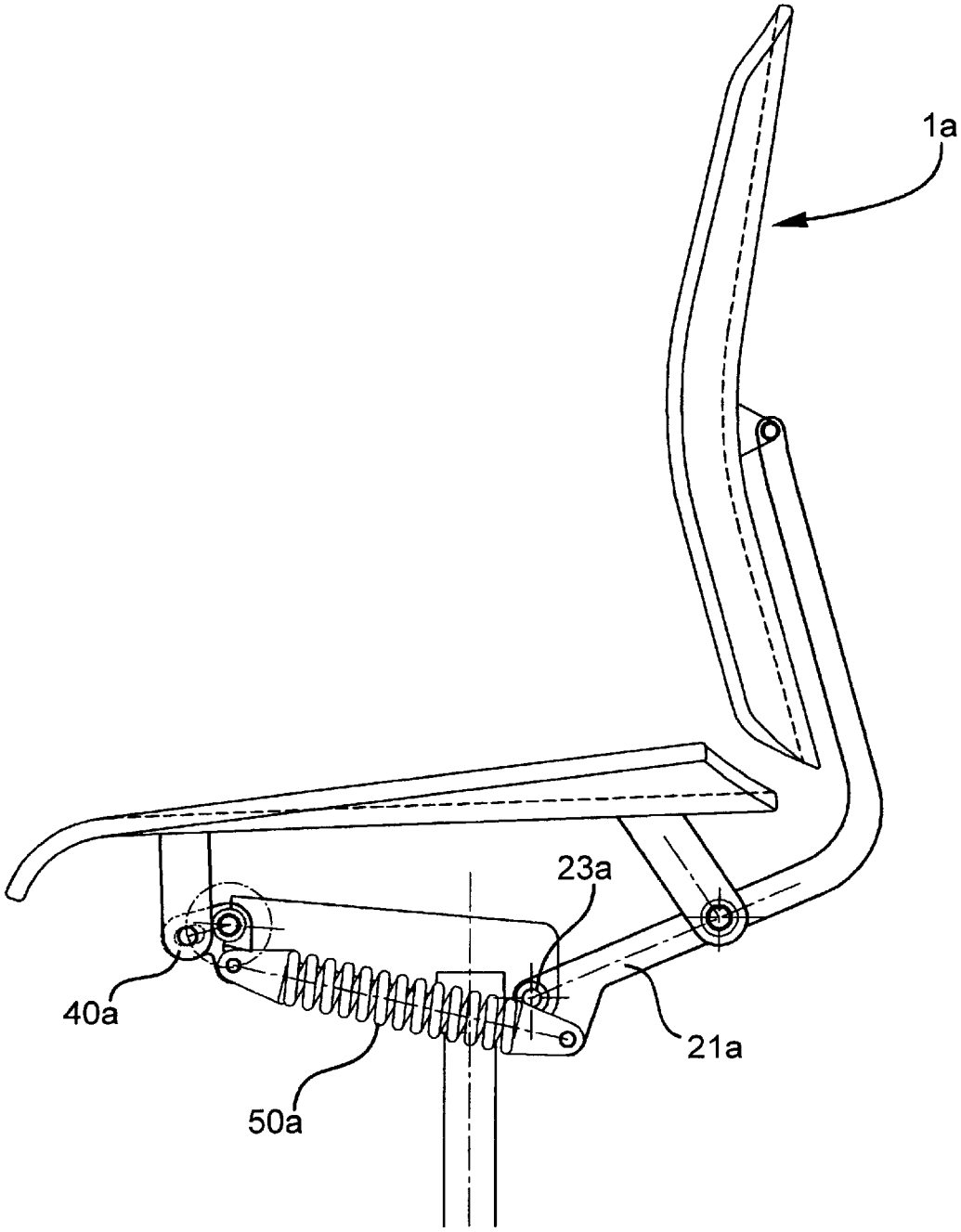
FIG. 10 shows a further embodiment of the chair of FIG. 1 in a side elevational view.

In FIG. 10 a chair 1*a* is illustrated which is substantially similar to the chair of FIG. 1, except that a compression or pressure spring 50*a* is provided instead of the extension spring 50 shown in FIG. 1. A slight modification of the mounting location for the spring 50*a* is provided on an angle lever 40*a* and a backrest carrier 21*a* as illustrated to accommodate the opposite force provided by the spring 50*a*. In all other respects, the chairs are the same and similar modifications can be made as discussed with respect to FIGS. 6–9.

That is, the second or rearward lever arm of the swivelling lever 40*a* connected to a front end of the pressure spring 50*a* points downwards or is angled downwards, and a connection of a new end of the pressure spring with the backrest carrier 21*a* is offset downwards and spaced away from the backrest carrier swivelling joint 23*a*. The lever arms of the angle lever 40*a* form an angle of between 70° and 110° with each other.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A chair comprising:

a seat top with at least one front seat support arm and at least one rear seat support arm projecting at the underside of the seat top, a seat carrier securely connected to a chair support, a backrest mounted to a backrest carrier which firstly extends rearwardly under the seat top and thereafter upwards, the backrest carrier is connected to the seat carrier by means of a crosswise horizontally extending backrest carrier swivelling joint, and the front seat support arm is articulately connected to the seat carrier through a lever, wherein the rear seat support arm, offset backwards from the backrest carrier swivelling joint, is articulately connected to the backrest carrier by means of a crosswise horizontally extending rear seat joint, a spring arrangement provided under the seat top with the spring arrangement exerting a biasing force upwards upon the seat top and forwardly upon the backrest, said lever connecting the front seat support arm with the seat carrier comprising a two-arm swivelling lever pivotable around a crosswise horizontally extending swivelling axis, and supported at the seat carrier with one lever arm of the swivelling lever articulately connected to the front seat support arm, and with the other lever arm of the swivelling lever connected to a front end of the spring arrangement, and a rear end of the spring arrangement being connected to the backrest carrier at a connection point spaced apart from the backrest carrier swivelling joint.

2. The chair according to claim 1, wherein at least one tension spring is provided as the spring arrangement, that the second lever arm of the swivelling lever connected to the front end of the tension spring points rearward, and that the connection of the rear end of the tension spring with the backrest carrier is offset upwards from the backrest carrier swivelling joint.

3. The chair according to claim 2, wherein the swivelling lever is designed as a lever angled between 0 and 45° between its two arms.

4. The chair according to claim 1, wherein at least one pressure spring is provided as the spring arrangement, that the second lever arm of the swivelling lever connected to a front end of the pressure spring points downwards or is angled downwards, and that a connection of a rear end of the pressure spring with the backrest carrier is offset downwards from the backrest carrier swivelling joint.

5. The chair according to claim 4, wherein the swivelling lever is designed as an angle lever with lever arms forming an angle of between 70° and 110° with each other.

6. The chair according to claim 1, including a mounting mechanism to adjust a force exerted upon the backrest by the spring arrangement.

7. The chair according to claim 6, wherein the connection point of the rear end of the spring arrangement at the backrest carrier is made at a second lever pivotally attached to said backrest carrier and is adjustable in a distance from the backrest carrier swivelling joint by the mounting mechanism.

8. The chair according to claim 7, wherein the second lever is lockable by the mounting mechanism and the rear end of the spring arrangement is connected to the backrest carrier through the second pivotable and lockable adjusting lever.

9. The chair according to claim 1, wherein the spring arrangement comprises at least one element from the group consisting of a helical, leg, torsion bar, gas pressure, rubber and elastomer spring.

10. The chair according to claim 9, wherein the spring arrangement comprises a gas pressure spring which is lockable in continuous or stepped positions.

11. The chair according to claim 1, further including a locking device wherein the backrest carrier pivotable around the backrest carrier swivelling joint may be locked in continuous or stepped swivelling positions by the locking device.

12. The chair according to claim 11, wherein at least one one-arm catch lever pivotable around a horizontal swivelling axis is connected to the backrest carrier in vertically spaced relationship from the backrest carrier swiveling joint, with the catch lever substantially extending horizontally to the seat carrier and freely displaceable in its longitudinal direction in relation to the seat carrier in a first, automatically occupied release position, and in a locking fashion engaging a locking element in a second, locking position occupied by adjusting an actuating element, wherein the locking element prevents a displacement of the catch lever in relation to the seat carrier.

13. The chair according to claim 12, wherein the locking element is at least one bolt extending through an elongated hole in the catch lever, wherein the elongated hole comprises at least one indentation extending downwards for receiving the bolt in the locking fashion.

14. The chair according to claim 12, wherein the locking element is formed by several projecting teeth extending in parallel at a radius around the swivelling axis of the catch lever with the teeth engageable and disengageable with corresponding teeth of the catch lever.

15. The chair according to claim 1, wherein the rear seat joint is adjustable and may be locked in its position in relation to the backrest carrier in the longitudinal direction thereof.

16. The chair according to claim 1, wherein two front and two rear seat support arms, two backrest carriers, and two spring arrangements are provided symmetrical in relation to a chair longitudinal middle plane.

* * * * *